United States Patent [19]

Pierlot

[11] 4,046,121

[45] Sept. 6, 1977

[54] FUEL SUPPLY DEVICES FOR INTERNAL COMBUSTION ENGINES

[75] Inventor: Michel E. Pierlot, Le Pecq, France

[73] Assignee: Societe Industrielle de Brevets et d'Etudes S.I.B.E., France

[21] Appl. No.: 599,025

[22] Filed: July 25, 1975

[30] Foreign Application Priority Data

Aug. 1, 1974 France ..... 74.26793

[51] Int. Cl.[2] ..... F02M 39/00

[52] U.S. Cl. ..... 123/139 AW; 261/50 A; 261/69 A

[58] Field of Search ..... 261/50 A, 69 A; 123/139 AW

[56] References Cited

U.S. PATENT DOCUMENTS

| | | | |
|---|---|---|---|
| 2,785,669 | 3/1957 | Armstrong | 123/119 |
| 2,857,203 | 10/1958 | Korte | 239/410 |
| 3,005,448 | 10/1961 | Ball | 123/119 R |
| 3,044,457 | 7/1962 | Ball | 123/139 AW |
| 3,259,378 | 7/1966 | Mennesson | 123/119 R |
| 3,404,667 | 10/1968 | Mennesson | 123/139 AW |
| 3,823,696 | 7/1974 | Mutschler | 123/139 AW |
| 3,842,813 | 10/1974 | Eckert | 123/139 AW |
| 3,867,913 | 2/1975 | Pierlot | 123/139 AW |
| 3,882,206 | 5/1975 | Gural et al. | 261/50 A |

FOREIGN PATENT DOCUMENTS

| | | | |
|---|---|---|---|
| 1,309,918 | 10/1961 | France | 123/139 AW |

OTHER PUBLICATIONS

Automotive Industries No. 114, Aug. 15, 1956, pp. 70–71.

*Primary Examiner*—William R. Cline
*Assistant Examiner*—H. Jay Spiegel
*Attorney, Agent, or Firm*—Stevens, Davis, Miller & Mosher

[57] ABSTRACT

A fuel supply device for internal combustion engines has an injector formed with an injection orifice whose cross-sectional area is adjusted responsive to the position of an auxiliary throttle element located in the intake pipe of the engine and opening automatically and progressively in dependence upon the rate of engine intake air flow. The area is also adjusted as an increasing function of the difference between the pressures upstream and downstream of the auxiliary throttle element.

9 Claims, 4 Drawing Figures

FUEL SUPPLY DEVICES FOR INTERNAL COMBUSTION ENGINES

BACKGROUND AND SUMMARY OF THE INVENTION

This invention relates to supply devices for internal combustion engines of the kind which inject fuel into the engine inlet manifold.

Prior art fuel supply devices of the kind set forth comprise a driver-controlled main throttle element located in the intake pipe of the engine and an auxiliary throttle element usually, but not necessarily, disposed upstream of the main throttle element and opening progressively and automatically in proportion as the rate of air flowing through the inlet tube increases. To this end, the auxiliary throttle element can be connected to a movable element subjected to the air pressure prevailing in that portion of the intake pipe which is between the auxiliary throttle element and the main throttle element (at least when the main throttle element is disposed downstream of the auxiliary throttle element). The extent of opening of the auxiliary throttle element is a yardstick for the rate of air flow through the inlet manifold, and a pressure drop which is either substantially constant or which is a predetermined and increasing function of the engine intake air flow is established between the upstream and downstream sides of the auxiliary throttle element.

Such a device is described in French Patent Specification No. 1,519,890.

The fuel injection delivery is controlled by a system having a metering element which is connected to the auxiliary throttle element and which is adapted to move in dependence upon the extent of opening of the latter element so as to vary the fuel flow cross-sectional area proportionally to the air flow cross-sectional area metered by the auxiliary restriction, so that the air fuel mixture remains of substantially constant richness.

That device operates satisfactorily. However the greater part of the pressure drop experienced by the fuel after the fuel pump occurs before the fuel is forced through the injection orifice — i.e., before the fuel is atomized for introduction into the engine intake manifold. Atomization is of course more complete in proportion as the injection pressure is higher, and if the residual velocity of the fuel in the injection orifice is too low atomization may become inadequate. Pressure losses occurring before injection of the fuel should therefore be kept to a minimum.

The injection device of U.S. Pat. Nos. 2,785,669 and 2,857,203 exhibits the same shortcoming: a notable fraction of the fuel pressure available at the pump outlet is lost in the form of pressure loss before the injection orifice.

It is an object of the invention to provide a fuel supply device which performs better in practice than the prior art, inter alia by greatly reducing the disadvantages mentioned.

According to the invention there is provided a fuel supply device for internal combustion engines having means for injecting fuel under pressure into the engine intake through at least one adjustable cross-sectional orifice of adjustable cross section, an auxiliary throttle element located in the air intake pipe opening automatically and progressively in increasing dependence upon the rate of engine intake air flow, and means for metering the cross-sectional area of the injection orifices as an increasing function of the extent of opening of the auxiliary throttle element and as an increasing function of the difference between the pressures upstream and downstream of the latter element.

The metering means can comprise a piston movable in a stationary tubular member whose side wall is formed with the injection orifice or orifices, the effective cross-sectional area thereof being determined by the position of the piston. The same is secured to a movable element, such as a diaphragm, experiencing the difference between the pressures upstream and downstream of the auxiliary throttle element and to a movable element experiencing a differential pressure which is directly related to the extent of opening of the automatic throttle element.

In the system just defined most of the pressure drop in the fuel circuit occurs at the place where the fuel is injected, and so the flow velocity through the or each injection orifice is used to provide satisfactory atomization.

The invention will be better understood from the following description of an exemplary and non-limitative embodiment, reference being made to the accompanying drawings.

SHORT DESCRIPTION OF THE DRAWINGS

DESCRIPTION OF PREFERRED EMBODIMENTS

Figure 1:
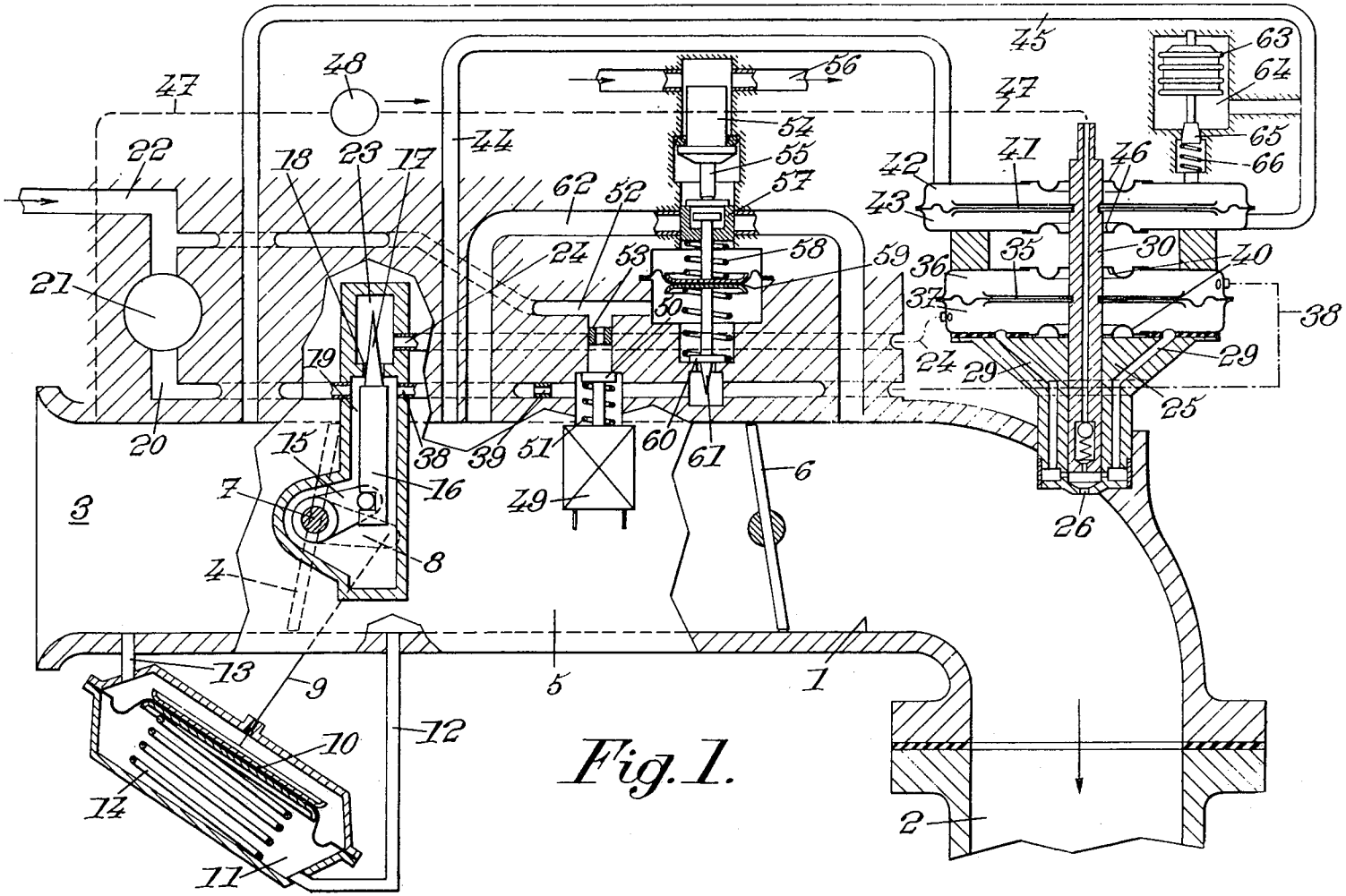
FIG. 1 is a very diagrammatic view of the complete system in cross section.

The device whose elements are shown in FIG. 1 in their normal positions comprises an air intake pipe 1 connected to an engine inlet manifold 2. Disposed in the intake pipe 1, starting from an air entry 3 which usually has an air filter (not shown), are an auxiliary throttle element 4, a chamber 5 and a main throttle element 6 operated by the driver through a linkage (not shown). In the embodiment shown both of the elements 6 and 4 are butterfly valves.

The auxiliary throttle element 4 is connected to an axle 7 which carries a lever 8. The lever is connected by a rod 9 to a deformable diaphragm 10 which operates element 4. Diaphragm 10 separates a capacity 11, which communicates via a passage 12 with chamber 5, from another capacity connected to air entry 3 via a passage 13. A spring 14 biases auxiliary throttle element 4 toward closure whereas the underpressure transmitted through passage 12 tends to open element 4. A mechanism of this kind is well known and opens the element 4 when the engine draws air because of the main throttle element 6 opening, until an underpressure which depends on the characteristics of the spring 14 is produced in chamber 5. Consequently, the opening angle of the automatic element 4 is a yardstick of the rate of engine air intake, the relationship depending upon the characteristics of the spring and the opening being accompanied by a slight pressure drop between the upstream and downstream sides of the element 4.

By way of axle 7 the element 4 is connected to a lever 15 moving a needle 16 or the like; a portion 17 of the needle is tapered and has a cross-section which varies in accordance with an appropriate pattern and moves in a calibrated passage or orifice 18. By way of passage 18, a chamber 19 which a passage 20 connects to the delivery of a fuel pump 21 communicates with a chamber 23 from which a passage 24 extends. Pump 21 draws fuel from a tank (not shown) through a pipe 22.

Figure 2:
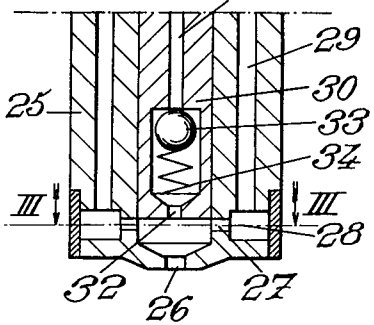
FIG. 2 is a view on an enlarged scale of the injector of the system of FIG. 1 in section along the injector axis.
Figure 3:
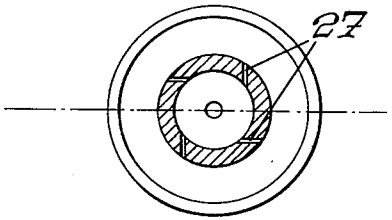
FIG. 3 is a view in cross-section along line III—III of FIG. 2.

The means for injecting fuel into the engine inlet manifold and for controlling the rate of fuel flow comprises a tubular member 25 (FIGS. 1 and 2). Member 25 projects into intake pipe 1 and has a terminal frustoconical portion formed with a central aperture 26 opening toward the manifold 2. A plurality of lateral restricted orifices 27 (FIG. 3) open into a central cavity of member 25 near aperture 26 and are directed substantially tangentially. The number and arrangement of the orifices 27 can be varied according to the requirements of the engine. The orifices 27 receive fuel via an annular chamber 28 (FIG. 3) fed via at least one passage 29. The fuel which enters the central cavity or recess of casing 25 through the orifices 27 initiates swirl, then leaves the injector through the aperture 26 in finely divided form as a slightly conical spray jet.

The orifices 27 have a cross-sectional area much smaller than that of aperture 26 for the head loss impressed to the fuel flow across orifices 27 to be much in excess of the head loss across aperture 26 (typically, at least 10 times higher). Aperture 26 may for instance be 2.4 mm in diameter while the orifices 27 are axial slots 0.4 mm broad.

A piston or plunger 30 slidable in the cylindrical recess of member 25 has a lower edge which meters the open cross-sectional area of the orifices 27 — i.e. the fuel flow cross-sectional area and therefore the quantity of fuel intaken by the engine. Piston 30 is typically formed with a central duct 31 which terminates in an orifice 32 at the centre of the lower surface of piston 30. Duct 31 has a non-return check valve in the form of a ball 33 biased toward a seat by a spring 34.

Piston 30 is secured to a first diaphragm 35 which separates two chambers 36 and 37 in a stationary casing. Chamber 36 communicates with chamber 19 via a duct 38 having a restricted calibrated passage 39. Chamber 37 communicates with chamber 23 via duct 24. Two flexible gaskets 40 prevent fuel losses along piston 30. The diaphragm 35 experiences a downwardly directed force which is proportional to the difference between the pressures in chambers 36 and 37. Piston 30 is also secured to a second diaphragm 41 which separates two chambers 42 and 43 in a stationary casing. Chamber 42 communicates with portion 5 of intake pipe 1 via a duct 44. Chamber 43 communicates with air intake 3 via a duct 45. Two flexible gaskets 46 prevent leakage of air to the outside of the system.

The central passage 31 of piston 30 communicates via a pipe 47 with the air intake 3; in the embodiment shown, the pipe 47 is provided with a low-capacity air pump 48.

A start system has an electromagnet 49 which when energized opens a valve 50 against the force of a return spring 51. When open, valve 50 connects passage 38 and a duct 52 connected to the fuel intake passage 22. A calibrated orifice or passage 53 is provided between the seat of valve 50 and the duct 52. The circuit of electromagnet 49 is connected to the starting motor circuit and has a thermostatic device which opens the circuit at low ambient temperatures. Valve 50 therefore opens only when the starting motor operates and only at sufficiently low temperatures; at average and high temperatures there is no need for the valve 50 to operate and operation thereof is actually inhibited.

The start system also comprises a heat-sensitive element 54 (FIGS. 1 and 4); element 54 has a rod or the like 55 which is moved downwardly in response to an increase in the temperature of element 54. The element 54, e.g. a capsule filled with a substance having a high coefficient of expansion, is heated e.g. by the engine coolant flowing through duct 56. It can be heated in some other way, e.g. by an electric resistance which is energized at closure of the ignition circuit; it can also be swept by the engine cooling air, engine exhaust gases or the like.

Figure 4:
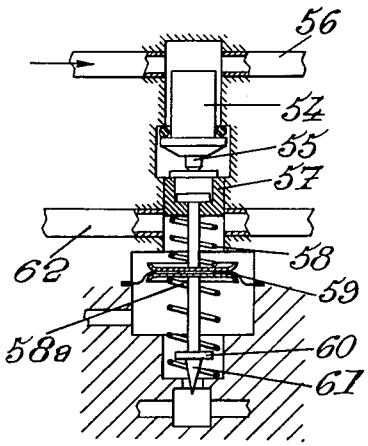
FIG. 4 is a detail view showing the cold start system of the system of FIG. 1 in a different position, corresponding to a lower temperature.

The rod 55 bears on a diaphragm 59 through a piston 57 and spring 58. Diaphragm 59 actuates a valve poppet 60 having a variable cross-section needle 61. When the heat-sensitive element 54 is at a low temperature a return spring 58*a* lifts valve 60 (FIG. 4) so that passages 38 and 52 communicate via the annular gap bounded by needle 61 and by the seat of valve 60. Then the piston 57 is high enough to allow air to enter the passage 62 (via which portion 5 of intake pipe 1 communicates with that portion of the intake pipe disposed downstream of the main throttle element 6 (FIG. 4).

The system can also comprise means for correcting mixture richness in dependence upon other engine operation parameters. FIG. 1, for instance, shows an element for decreasing mixture richness with increasing altitude. The element shown in FIG. 1 mainly comprises a barometric capsule 63 enclosed in a capacity 64 experiencing the pressure at the air intake as communicated via passage 45. Capsule 63, when it expands, opens a valve 65 against the force of a return spring 66 and thus causes an air leak which increases the pressure in chamber 42. Instead of the capsule 63, an other element responsive to an operation parameter for adjusting an air leak to chamber 42 from passage 45 can be used. More particularly, to correct mixture richness in dependence upon exhaust gas characteristics, a detector can be placed in the exhaust gas flow for delivering an electrical signal causing permanent or periodic opening of the leakage passage.

Operation of the system is as follows:

The extent of opening of the driver-controlled main throttle element 6 meters the engine intake air flow. At any opening of the element 6 the auxiliary throttle element 4 automatically takes up a balance position which depends upon the strength and stiffness of spring 14. A particular position of needle 17 relatively to calibrated orifice 18 and therefore a fuel flow cross-sectional area correspond to that balance position and are therefore mainly responsive to the air flow cross-sectional area.

The fuel delivered by pump 21 under pressure flows into chamber 19 and therefrom:

to chamber 36 via duct 38, and to chamber 37 via calibrated orifice 18 and passage 24.

Fuel leaves chamber 37 through the or each passage 29 to the annular chamber 28 (FIG. 2).

That fuel then flows out of chamber 28 through the orifices 27 under a considerable pressure difference and is atomized when it issues from the injector through the aperture 26.

The effective cross-sectional area of the orifices 27, adjusted by the position of piston 30, is finally controlled by the auxiliary throttle element 4, since for any given position of needle 17 in the orifice 18, the piston 30 takes up a balance position determining a particular effective cross-sectional area of the orifice 27. If the effective cross-sectional area tends to increase and to become in excess of that corresponding to the position of element 4, the pressure in chamber 37 drops and the pressure in chamber 36 moves back the piston 30 to partly close the orifices 27 until the pressure in chamber 37 has increased and restored the balance of the forces acting on piston 30.

To allow for the fact that the air head loss between the upstream and downstream sides of the automatic auxiliary throttle element 4 is not strictly constant, first because the force of the spring 14 somewhat varies with the position of diaphragm 10 and second because in transient conditions the head loss may experience large variations for short time periods, the position of piston 30 is also adjusted in dependence upon the air pressure difference between the upstream and downstream sides of element 4; piston 30 is therefore connected to diaphragm 41 which acts in the same way as diaphragm 35 but does not necessarily have the same diameter as diaphragm 35.

If for instance the amount of underpressure in chamber 5 increases, it is transmitted through passage 44 to chamber 42 and biases the piston 30 to increase the effective cross-sectional area of the orifices 27. Such an action is correct, since an increase in the air flow rate corresponds to an increase in the underpressure in portion 5 and the fuel flow rate requires a corresponding correction.

The fuel outlet cross-sectional area (i.e., that cross-sectional area of the orifices 27 which is left free by the piston 30) is determined by the position of the automatic throttle element 4 which actuates the needle 17 and by the head loss of air across element 4.

The orifices 27 may vary in shape within very wide limits and can be in the form of slits or holes. They can be distributed around a circular portion and at different levels so that the piston 30, as it moves upwards in the figure, opens one or two or three or more orifices consecutively.

Atomization can still be improved if air is injected into the central chamber of the injector, for instance, via passage 31. In most engine operating conditions a strong underpressure prevails in the portion of the intake pipe which is located downstream of the main throttle element 6, so that air is sucked through passage 31 by the underpressure which also prevails in the chamber under piston 30.

However, in some cases (when the engine is running slowly under full load) the underpressure downstream of the element 6 is virtually zero. For preventing fuel from flowing back through passage 31 to the air entry 3, there is provided check valve 33 which does not prevent the aspiration of atomizing air.

An air blower 48 can be provided for delivering device air and to improve atomization, particularly when the available underpressure is low.

As is apparent, most of the fuel pressure drop occurs across the orifices 27 opening into the injector chamber i.e., at the place where atomization occurs, since the pressure drop in orifice 18 may be low and in any case much lower than the pressure drop occurring at the orifices 27. Typically the ratio of the pressure drops is about 1/30.

The output pressure of pump 21 is therefore used for atomization purpose since such pressure remains virtually complete as far as the orifices 27 which are the actual mixture-atomization elements. Aperture 26 is in fact for aspiration and proper location of the fuel spray jet.

The system may easily be provided with correcting means. The mixture can be rendered leaner by adjusting a calibrated communication between the chambers 42 and 43; such a communication has virtually no effect on the underpressure in chamber 43 but decreases the amount of underpressure in chamber 42, so that the piston 30 moves down and, all other parameters being equal, throttles the orifices 27 a little more. Altitude correction can be provided, as shown. Corrections can be made equally well or additionally by any system adapted to provide a similar communication in dependence upon any other parameter (for intense exhaust gas composition).

The start system is also very safe in operation. In the cold start position shown in FIG. 4, piston 57 opens passage 62 to allow an additional air flow when the main throttle element 6 is the closed position. The leak past needle 61 alters the pressure difference acting on diaphragm 35 so as to lift piston 30 and to enrich the mixture. As the thermostat element 54 heats up simultaneously with the engine, the movement of rod 55 restricts the rate of fuel flow around the needle 61 and then causes closure of the valve 60 simultaneously as piston 57 closes the air passage 62. The elements are then in the position shown in FIG. 1.

At very low ambient temperatures the electromagnet 49 opens the valve 50 in response to operation of the starting motor. Additional leak occurs from passage 38 and there is an additional opening of the orifice 27 to provide a higher rate of fuel flow during starting. Such action ceases immediately when the starting motor is de-energized.

I claim:

1. A device for supplying fuel to an internal combustion engine having an intake pipe, said device comprising:

a source of fuel, injector means for injecting fuel into the engine intake, said injector means including a fuel chamber and at least one injection orifice of adjustable cross-sectional area for fuel flow out of said chamber, fuel conduit means receiving fuel from said fuel source and discharging fuel into said chamber, an auxiliary throttle element located in the intake pipe of the engine and opening automatically and progressively in dependence upon the rate of engine intake air flow, proportioning valve means disposed in said fuel conduit, said valve means being operatively connected to said auxiliary throttle element to proportion the cross-sectional area of the fuel conduit means available for fuel flow to the amount of opening of said auxiliary throttle element, and means for adjusting the cross-sectional area of said injection orifice, said adjusting means being controlled by means responsive to the amount of opening of said throttle element and by means responsive to the difference between the pressure upstream and that downstream of the auxiliary throttle element, whereby the cross-sectional area of said injection orifice is increased in proportion to the amount of opening of the auxiliary throttle element and to said pressure difference.

2. A device according to claim 1, having means for correcting the richness of the fuel-air mixture in dependence upon secondary engine operation parameters, such as ambient atmospheric pressure, temperature, speed and exhaust gas composition.

3. A device for supplying fuel to an internal combustion engine having an intake pipe, said device comprising injector means for injecting fuel into the engine intake through at least one injection orifice of adjustable cross-sectional area, an auxiliary throttle element in the intake pipe of the engine and constructed to open automatically and progressively in dependence upon the rate of engine intake air flow, means responsive to the amount of opening of said auxiliary throttle element and responsive to the difference between the pressure upstream and that downstream of the auxiliary throttle element for adjusting the cross-sectional area of the injection orifice, said means for adjusting the cross-sectional area of the injection orifice comprises a piston movable in a stationary tubular member whose side wall is formed with injection orifices, including said at least one injection orifice, whose effective cross-sectional area is determined by the position of said piston, a first movable element subjected to the difference between the pressure upstream and that downstream of said auxiliary throttle element operatively connected to said piston for moving said piston, and a second movable element subjected to a pressure differential dependent upon the extent of opening of said auxiliary throttle element and acting oppositely to the difference between the pressure upstream and that downstream of the auxiliary throttle element.

4. A device according to claim 3, further comprising: means for correcting the richness of the fuel-air mixture in dependence upon secondary engine operation parameters.

5. A device according to claim 4, wherein the means for correcting the richness of the fuel-air mixture comprises a leakage orifice in a chamber experiencing one of the pressures acting on the movable elements so as to modify the pressure in such chamber, and means for adjusting the cross-sectional area of the leakage orifice responsive to a valve controlled by one at least of said parameters.

6. A device according to claim 4, further comprising a source of compressed air, the injecting means comprises a passage for supplying compressed air from the source for drawing fuel issuing from the variable cross-sectional area orifice and for completing atomization of such fuel before the same enters the engine.

7. A device according to claim 6, further comprising a non-return check valve in the passage for blocking the return of fuel towards the compressed-air source.

8. A device according to claim 3, wherein one surface of the second movable element experiencing a pressure differential varying with the extent of opening of the automatic throttle element bounds a chamber connected to the delivery of a fuel pump, the opposite surface of the last-mentioned movable element bounding a second chamber connected to said delivery by way of a calibrated passage whose cross-section is modified responsive to the extent of opening of the auxiliary throttle element.

9. A device according to claim 8, wherein the at least injection orifice is supplied from the second chamber.

* * * * *